United States Patent [19]

Nagati

[11] 4,260,140

[45] Apr. 7, 1981

[54] METALLURGICAL VESSEL

[75] Inventor: Rashed N. Nagati, Mars, Pa.

[73] Assignee: Pennsylvania Engineering Corporation, Pittsburgh, Pa.

[21] Appl. No.: 75,161

[22] Filed: Sep. 12, 1979

[51] Int. Cl.[3] ..... C21C 5/50

[52] U.S. Cl. ..... 266/246

[58] Field of Search ..... 266/246

[56] References Cited

U.S. PATENT DOCUMENTS

| | | | |
|---|---|---|---|
| 3,455,545 | 7/1969 | Campbell | 266/246 |
| 3,653,648 | 4/1972 | Mevissen | 266/246 |
| 3,653,649 | 4/1972 | Mevissen | 266/246 |
| 3,797,815 | 3/1974 | Seki | 266/246 |
| 3,799,527 | 3/1974 | Fisher | 266/246 |
| 4,061,318 | 12/1977 | Fisher | 266/246 |
| 4,121,811 | 10/1978 | Fisher | 266/246 |

*Primary Examiner*—P. D. Rosenberg

[57] ABSTRACT

A refractory lined vessel has an open top and a plurality of brackets for engaging a trunnion ring to which it is coupled by bracket retainer assemblies. Each bracket retainer assembly includes pairs of gib plates affixed to the trunnion ring adjacent the opposite sides of the brackets and end members having feet which extend into openings in the plates for being retained in position by suitable shims and having aligned bores for receiving the end of a shaft which also extends to each of the bracket gusset plates.

13 Claims, 5 Drawing Figures

METALLURGICAL VESSEL

BACKGROUND OF THE INVENTION

This invention relates to metallurgical vessels and more particularly to retainer assemblies for coupling the vessel support brackets to a trunnion ring support.

Pneumatic steel making vessels generally include an open topped, refractory lined steel shell for containing a charge of molten metal. Oxygen gas commonly delivered to the metallic charge either by a lance or tuyeres which extends through the bottom or side of the vessel. Hot metal or scrap is initially charged into the vessel through its top opening. Vessels of this type are normally supported by a trunnion ring secured to the vessel and trunnion pins extending outwardly from the ring so that the vessel may be tilted for charging, pouring or sampling. One type of vessel mounting assembly includes brackets secured to the vessel are held in engagement with the upper surface of the trunnion ring by a bracket retainer assembly. Typically, the trunnion ring bracket includes a first plate affixed to the vessel and a second plate which extends generally radially for engaging the upper trunnion ring flange. Because of vessel expansion and contraction during operation, the second bracket plate is normally secured along its edges by gib assemblies to permit relative radial movement of the bracket relative to the trunnion ring flange. A gib assembly might, for example, include a first member welded to the trunnion ring flange and a second member attached to the first and extending over the edge of the bracket plate. The gaps which would exist between the gib assembly and the bracket plates would normally be filled with wedges or shims to secure the bracket plate in position.

Prior art bracket retainer assembly of the type described are not entirely satisfactory because stresses tend to concentrate on the overhanging gib member along the edge of the bracket plate. Further, because of the physical configuration of prior art gib assemblies, maintenance was often relatively difficult.

SUMMARY OF THE INVENTION

It is an object of the invention to provide a new and improved retainer assembly for securing metallurgical vessel support plates to a trunnion ring.

A further object of the invention is to provide a trunnion ring bracket retainer assembly which more evenly distributed the load over the support bracket and retainer assembly.

Yet another object of the invention is to provide a trunnion ring bracket retainer assembly which is easy to maintain.

These and other objects and advantages of the present invention will become more apparent from a detailed description thereof taken with the accompanying drawings.

In general terms, the invention comprises a retainer assembly for affixing a metallurgical vessel support bracket to a trunnion support and includes first and second members secured by fixed means disposed on a trunnion support adjacent to the lateral edges of the bracket wherein the first and second members include aligned sleeve means for receiving a shaft which extends through the trunnion support bracket and wherein the first and second members are held for a limited radial movement on the trunnion ring by frictual engagement with the fixed means.

DETAILED DESCRIPTION OF THE PREFERRED EMBODIMENT

Figure 1:
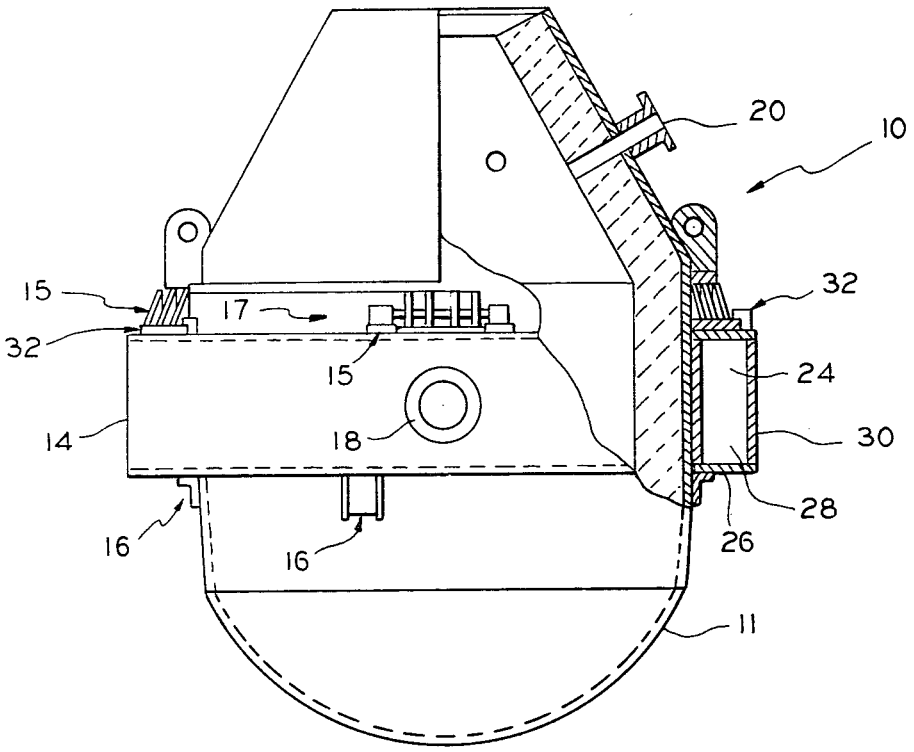
FIG. 1 is a side elevational view, partly in section, of a metallurgical vessel incorporating the present invention.

The invention will be illustrated in connection with a convertor 10 having a metallic shell 11 and a refractory lining 12 which define a vessel having an open top. Means, not shown, but which are well known in the art, may be provided for delivering oxygen to a molten metal charge contained within the vessel. Such oxygen delivery means may comprise a removable lance (not shown) which is inserted through the open, upper end of vessel 10 or tuyeres (not shown) for delivering oxygen and other gases such as a hydrocarbon shielding fluid or argon either through the side or bottom of the vessel. It will be appreciated that it is not intended to limit the invention to a vessel having any particular type of oxygen delivery system.

The vessel 10 is supported on a trunnion ring 14 by means of an upper support assembly 15 and a lower support assembly 16. A trunnion pin 18 extends from each of the opposite sides of trunnion ring 14 and in a generally coaxial relation and each is supported in a well known manner on bearing structures (not shown). In addition, a conventional drive apparatus (not shown) is connected to one of the trunnion pins 18 for tilting the vessel through its various operative positions to permit charging, deslagging, sampling, temperature measurement or the discharge of hot metal through a teeming spout 20.

Figure 2:
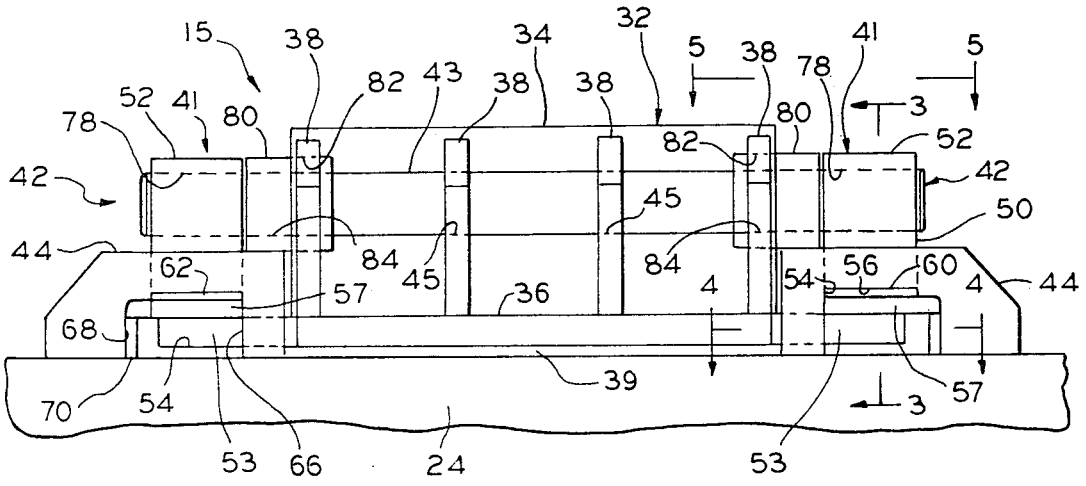
FIG. 2 is a side view showing the bracket retainer assembly of the present invention in greater detail.

The trunnion ring 14 is generally annular and includes an upper flange 24, a lower flange 26, an inner side wall 28 and an outer side wall 30. Each upper support 15 is shown in FIG. 2 to include a bracket 32 consisting of a side plate 34 and a bottom plate 36 which is secured to and extends generally in a perpendicular direction relative to side plate 34. In addition, there are a plurality of gusset plates 38 which interconnect the side and bottom plates 34 and 36. The members 34, 36 and 38 which form the bracket 32 may be affixed to each other and to the vessel in any suitable manner such as by welding. Alternately, the back plate 34 may be bolted to the vessel surface. The lower surface of plate 36 may rest directly upon the upper surface of trunnion ring flange 24 or there may be a plate 39 of a wear resistant material disposed there between. In this manner, the brackets 32 which are spaced around the vessel and which rest on the trunnion ring flange 24 provide vertical support for vessel 10.

Figure 3:
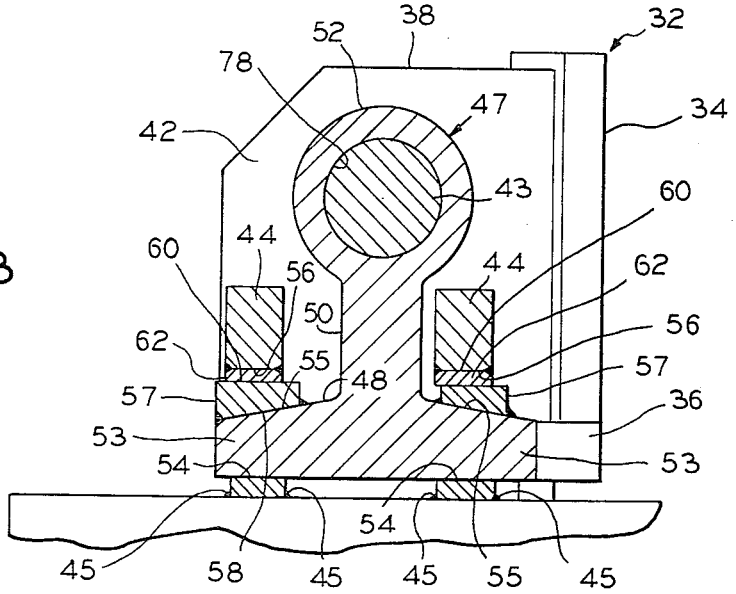
FIG. 3 is a view taken along lines 3—3 of FIG. 2.
Figure 4:
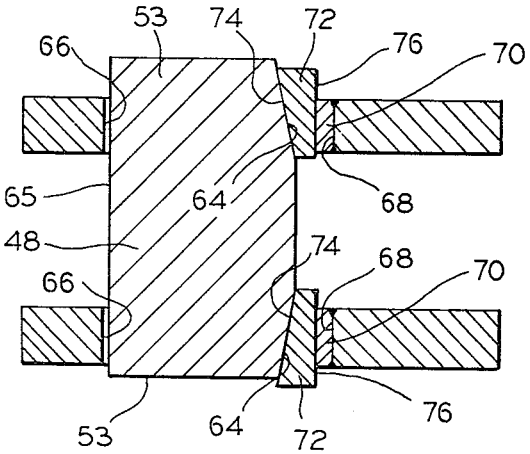
FIG. 4 is a view taken along lines 4—4 of FIG. 2.
Figure 5:
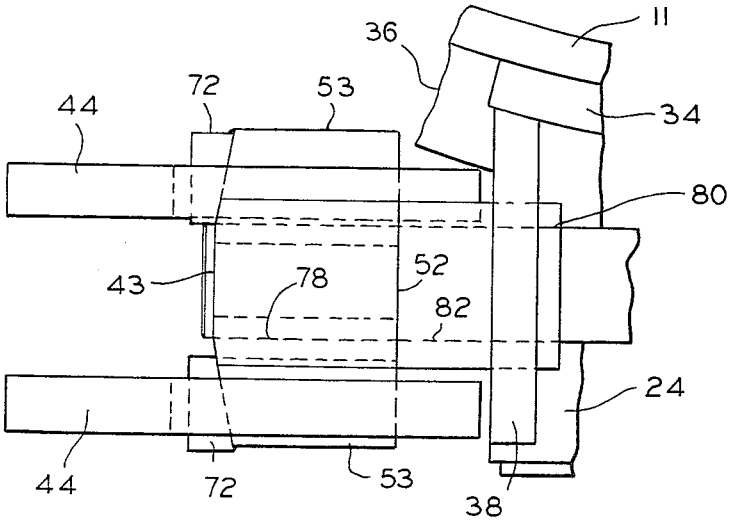
FIG. 5 is a view taken along lines 5—5 of FIG. 2.

In order to maintain the bracket 34 in position adjacent the surface of trunnion ring flange 24, a pair of retainer assemblies 41 are provided. Each of the assemblies 41 is shown in FIGS. 2–4 to include an end section 42 which is affixed to the trunnion ring flange 24 adjacent the opposite ends of bracket 32 and a shaft 43 which extends between the end sections 42 and through suitably aligned openings 45 in each of the gusset plates 38. Each end section includes a pair of gib plates 44 which are welded along both their lower lateral edges 45 to the upper surface of the trunnion ring flange 24 and in a parallel spaced-apart relation. In addition, the inner edges of each pair of gib plates 44 are disposed adjacent one side of the bracket 32 and the gib plates 44 of each cooperating pair of end sections are in alignment.

Each end section 42 also includes an end member 47 having a base portion 48. A body portion 50 extends upwardly from the base 48 and there is an integral head portion 52 at its upper end. The base portion 48 has a pair of outwardly extending foot portions 53 which extend through slots 54 formed in each of the gib plates 44. The upper surfaces 55 of each foot portion 53 is inclined outwardly and downwardly and are spaced from the upper surface 56 of slot 54. Affixed to each of the surfaces 55 are shims 57 whose lower surfaces 58 are tapered and complimentary to the surfaces 55 of foot portions 53. This orients the upper surfaces 60 of each shim 57 in a generally horizontal relation for engaging a flat abrasion resistant bar 62 welded to the upper edge of slot 54.

Each base 48 shown in FIG. 4 to be generally rectangular in plan view except that the rear surfaces of the feet portions 53 have inwardly tapered surfaces 64. The front surface 65 of base 48 is disposed in an abutting relation to the adjacent surface 66 of slot 54. Affixed in any suitable manner such as by welding to the opposite surfaces 68 of slots 54 are abrasion resistant bar members 70. Dispersed between the number 70 and the surfaces 64 are shims 72 each of which has a tapered front surface 74 complimentary to the surface 64 and a rear surface 76 which is parallel to the side surface of number 70.

Each of the head portions 52 of end members 47 has a longitudinal bore 78 extending therethrough and aligned with the corresponding bore formed in the end member at the opposite side of flange 32. A coaxial sleeve member 80 is secured in an opening 82 and each of the outermost gusset plates 38 and each has an axle bore 84 which has the same inner diameter as and is coaxial with the bore 78 in head 52. The ends of the shaft 43 are affixed in the bore 78 of each of the end members 47 and extends through bores 84 in sleeves 80 and openings 45 formed in each of the inner gusset plates 38.

In assembly of the apparatus, the vessel will normally be lowered onto the trunnion ring 14 until the various lower plates 36 of brackets 32 engage wear plates 39 which have been positioned between pairs of gib plates 44 as shown in FIG. 2. It will be appreciated that the number and location of brackets 30 around the vessel will be determined by the size and weight of the vessel. Normally, about 4 to 6 brackets will be provided.

After the brackets 32 have been positioned, the end members 47 are placed between their associated gib plates 44 and with their feet 50 extending into slots 54. With the members 44 so positioned, the first shims 57 are forced into the gap between the upper surfaces 55 and the member 62 and the second shim 72 are forced into the gap between the surfaces 74 and the member 70. After the shims have been wedged into position, they are welded to the base 48 of member 47. Prior to affixing the shims, the bores 78 are aligned and the shaft 43 is extended therethrough and through bores 84 and the openings 45. The shaft 43 is then affixed in bores 78 in a suitable manner such as by means of pins.

As those in the art will appreciate, the vessel 10 will expand and contract during operation thereby tending to move the brackets 32 inwardly and outwardly relative to the gib plates 44. For this reason, the shims 57 and 72 are formed of a bearing material to permit the members 47 to move with the bracket 32 and relative to the gib plates 44.

The bracket retainer according to the present invention provides for a greater balance of forces so that there is consequently less wear on the retainer assembly 41. For example, when the vessel is tilted, its weight will be transferred from the brackets 32 to shaft 43 and each of the gib plates 38. Thus, the load forces are transferred throughout the bracket. In addition, the gib plates 44 engage the bracket retainer at a pair of locations which straddle the shaft 43. In addition, shims are provided at each of the loading points as opposed to single shims in prior art assemblies. In addition, because a pair of gib plates 44 are disposed in a spaced-apart relation, welding 45 can be provided along each side so that there are in effect 4 welded points in each gib assembly as opposed to the single weld employed in some prior art devices. Further, all of the welds 45 are exposed to facilitate assembly and maintenance. Also, because the points of engagement straddle the loading point, the stress is in the gib plates 44 and the welds are further reduced. Additionally, because the wear in the assembly due to relative movement between the members 47 and the plates 44 are concentrated in the shims which are more easily replaceable thereby further minimizing maintenance considerations.

The bottom support assemblies 16 form no part of the present invention and accordingly will not be discussed in detail. It is sufficient to state that these assemblies include members slidably mounted on the trunnion ring 14 and which are movable into and out of engagement with the vessel surface to provide stability when the vessel 10 is tilted. For more complete description of the lower assembly 16 reference is made to U.S. Pat. No. 4,061,318 which is assigned to the assignee of the present invention.

While only a single embodiment of the invention has been illustrated and described, it is not intended to be limited thereby but only by the scope of the appended claims.

I claim:

1. A metallurgical vessel, a trunnion support disposed adjacent said vessel, bracket means attached to said vessel for supporting the same on said trunnion support, and a bracket retainer assembly mounted adjacent at least some of said bracket means for retaining said bracket means adjacent said trunnion support, said bracket retainer assembly comprising first and second spaced-apart retainer members disposed respectively on the opposite sides of the adjacent bracket means and connecting means for coupling said retainer members to each other and to said bracket, first and second fixed means affixed respectively to said trunnion support adjacent one of said first and second retainer members, said fixed means each including a portion for engaging its associated retainer member to prevent movement of said retainer member and the bracket means coupled thereto away from said trunnion support and for permitting sliding movement thereof in a direction generally radial of said vessel. Whereby said retainer assembly and said fixed means retain said bracket means on said trunnion support but permit relative sliding movement.

2. The apparatus set forth in claim 1 wherein each said first and second fixed means includes a pair of fixed members affixed to said trunnion support and spaced-apart from each other generally in said radial direction, the portion of said fixed member including an opening formed therein and each retainer means including a projecting means extending in said generally radial direction and into said openings.

3. The assembly set forth in claim 2 wherein said projecting means and said openings each have a generally planar surface which are spaced-apart and diverge from each other at an acute angle extending in said radial direction, and shim means formed at said angle and disposed in the gap between said projecting means and said surfaces, said shim means being affixed to one of said members or retainer means and being slideably engageable with the other.

4. The assembly set forth in any of claims 1–3 wherein each of said first and second retainer members including an axial opening extending generally perpendicular to said radial direction and aligned with the axial opening in the other of said first and second retainer members, and shaft means extending between each of said axial openings and through said bracket means for securing said retainer members to said bracket means.

5. The assembly set forth in claim 4 wherein said bracket means includes a first plate portion affixed to said vessel and a second plate portion for supporting said vessel on said trunnion support, and a plurality of rib means extending between each of said plate portions, said shaft extending through each of said rib means.

6. The apparatus set forth in claim 5 wherein said pair of fixed members comprise a pair of plates which are spaced-apart from each other generally in said radial direction, said plates having a pair of opposite sides and a lower edge engaging said trunnion support, said plates being welded to said trunnion support at said lower edge and along each of said opposite sides.

7. The apparatus set forth in claim 6 wherein the openings in said fixed members each includes an upper surface extending generally in said radial direction, said projecting means includes a pair of projecting portions one of which extends respectively into the openings in each pair of fixed members, the upper surface of each projecting portion being formed at an acute angle relative to the upper surface of its associated opening and extending downwardly relative to said retainer member, a shim affixed to the upper surface of each projecting portion, each shim having an upper surface parallel to and in sliding engagement with the upper surface of said opening whereby said retainer is slideable relative to said plates.

8. The apparatus set forth in claim 1 wherein said pair of fixed members comprise a pair of plates which are spaced-apart from each other generally in said radial direction, said plates having a pair of opposite sides and a lower edge engaging said trunnion support, said plates being welded to said trunnion support at said lower edge and along each of said opposite sides.

9. The apparatus set forth in claim 8 wherein the openings in said fixed members each includes an upper surface extending generally in said radial direction, said projecting means includes a pair of projecting portions one of which extends respectively into each the openings in pair of fixed members, the upper surface of each projecting portion being formed at an acute angle relative to the upper surface of its associated opening and extending downwardly relative to said retainer member, a shim affixed to the upper surface of each projecting portion, each shim having an upper surface parallel to and in sliding engagement with the upper surface of said opening whereby said retainer is slideable relative to said plates.

10. The apparatus set forth in claim 9 wherein the openings in said fixed members each have an end surface extending generally in said radial direction, each projecting portion having side surfaces formed at an acute angle relative to the end surface of its associated opening and extending downwardly relative to said retainer means, an additional shim having a first side surface attached to the side surface of each projecting portion and a second surface parallel to and in sliding engagement with one side surface of each opening whereby said retainer is slideable relative to said plates.

11. A metallurgical vessel, a trunnion support disposed adjacent said vessel, bracket means attached to said vessel for supporting the same on said trunnion support, and a bracket retainer assembly mounted adjacent at least some of said bracket means for retaining said bracket means adjacent said trunnion support, each said bracket retainer assembly comprising first and second spaced-apart retainer means disposed respectively on the opposite sides of the adjacent bracket and connecting means for coupling said retainer mans to each other and to said bracket, each retainer means including a projecting portion, first and second fixed plate means each having an edge welded along a plurality of surfaces to said trunnion support adjacent one of said first and second retainer means, said plate means each including an opening for slideably engaging the projecting portion of the adjacent retainer means to prevent movement of said retainer means away from said trunnion support and for permitting sliding movement thereof in a direction generally radial of said vessel.

12. The apparatus set forth in claim 11 wherein said plate means includes a pair of plates affixed to said trunnion support and spaced-apart from each other generally in said radial direction, said retainer means being disposed between said plates and including projecting portions extending in said generally radial direction and into said openings.

13. The assembly set forth in claim 12 wherein said projecting portions and said openings each have a generally planar surface which are spaced-apart and diverge from each other at an acute angle extending in said radial direction, and shim means formed at said angle and disposed in the gap between said surfaces, said shim means being affixed to one of said members or retainer means and being slideably engagable with the other.

* * * * *

UNITED STATES PATENT AND TRADEMARK OFFICE

CERTIFICATE OF CORRECTION

PATENT NO. : 4,260,140

DATED : April 7, 1981

INVENTOR(S) : Rashed N. Nagati

It is certified that error appears in the above—identified patent and that said Letters Patent is hereby corrected as shown below:

Column 6, line 3, cancel "each"

Column 6, line 4, before "pair" insert -- each --.

Signed and Sealed this

Thirtieth Day of June 1981

[SEAL]

Attest:

RENE D. TEGTMEYER

Attesting Officer

Acting Commissioner of Patents and Trademarks